US008013268B2

(12) United States Patent
Ozil et al.

(10) Patent No.: US 8,013,268 B2
(45) Date of Patent: Sep. 6, 2011

(54) CIRCUIT BREAKER WITH A DOUBLE ACTING CIRCUIT-BREAKING CHAMBER AND AN INVERTED STRUCTURE

(75) Inventors: Joël Ozil, St Andre de Corcy (FR); Christophe Creusot, Miribel (FR); Jean-Luc Bourgeois, Lyons (FR); Christian Lindner, Zürich (CH)

(73) Assignee: Areva T&D SA, Paris la Defense Cedex (FR)

( * ) Notice: Subject to any disclaimer, the term of this patent is extended or adjusted under 35 U.S.C. 154(b) by 354 days.

(21) Appl. No.: 12/082,973

(22) Filed: Apr. 14, 2008

(65) Prior Publication Data

US 2008/0257866 A1 Oct. 23, 2008

(30) Foreign Application Priority Data

Apr. 17, 2007 (FR) ..... 07 54520

(51) Int. Cl.
*H01H 33/08* (2006.01)
*H01H 9/30* (2006.01)
*H01H 33/00* (2006.01)

(52) U.S. Cl. ..... 218/155; 218/1; 218/14; 218/17; 218/59; 218/84; 218/92; 335/201

(58) Field of Classification Search ..... 335/8, 15, 335/57, 71, 83, 97, 133, 156, 167–171, 196, 335/201–202; 218/1, 13–14, 17, 19–21, 218/43, 51, 53, 59, 62–65, 72, 84, 89–92, 218/155; 200/258
See application file for complete search history.

(56) References Cited

U.S. PATENT DOCUMENTS

| | | | | | |
|---|---|---|---|---|---|
| 1,922,862 | A * | 8/1933 | Prince | 218/91 |
| 1,951,210 | A * | 3/1934 | Ruppel | 218/84 |
| 2,909,633 | A * | 10/1959 | Umphrey | 218/91 |
| 3,527,912 | A * | 9/1970 | Jaillet | 218/66 |
| 4,342,891 | A * | 8/1982 | Solver | 218/59 |
| 4,354,072 | A * | 10/1982 | Noeske | 218/57 |
| 4,378,477 | A * | 3/1983 | Graf | 218/48 |
| 4,459,447 | A * | 7/1984 | Arimoto | 218/56 |
| 5,561,280 | A * | 10/1996 | Blatter | 218/59 |
| 6,049,050 | A * | 4/2000 | David | 218/154 |
| 6,342,685 | B1 * | 1/2002 | Perret | 218/78 |
| 7,339,132 | B2 * | 3/2008 | Urai et al. | 218/57 |

FOREIGN PATENT DOCUMENTS

| | | | |
|---|---|---|---|
| EP | 809269 | A2 * | 11/1997 |
| EP | 0822565 | A2 | 2/1998 |
| FR | 2491675 | | 4/1982 |
| FR | 2774503 | A1 | 8/1999 |
| FR | 2790592 | | 9/2000 |

* cited by examiner

*Primary Examiner* — Anh T Mai
*Assistant Examiner* — Mohamad A Musleh
(74) *Attorney, Agent, or Firm* — Nixon Peabody LLP

(57) ABSTRACT

This invention relates to a circuit breaker (1) for high or medium voltages, of the type having a drive bar (70) coupled to a drive member, and a circuit-breaking chamber (2) facing it and having two contacts (3, 4), each contact (3, 4) including a main contact (30, 40 respectively) and an arcing contact (31, 41 respectively), with one of the two contacts (3) being fixed to a blast or extinguishing nozzle (32). According to the invention, the second contact (4) and the drive bar (70) are joined together by coupling means (6) in such a way that they move together in translation in the same direction, the transmission means (5) being disposed on the side (21) of the chamber (2) that is adjacent to the drive bar (70), and are adapted to transmit the motion of the driven second contact (4) to the first contact (3).

19 Claims, 6 Drawing Sheets

CIRCUIT BREAKER WITH A DOUBLE ACTING CIRCUIT-BREAKING CHAMBER AND AN INVERTED STRUCTURE

CROSS REFERENCE TO RELATED APPLICATIONS OR PRIORITY CLAIM

This application claims priority to French Patent Application No. 07 54520, filed Apr. 17, 2007.

DESCRIPTION

1. Technical Field

The invention relates to circuit breakers for high or medium voltages, for which the drive energy is reduced by virtue of double-acting motion of the contacts.

More particularly, the invention relates to driving the contacts of a circuit-breaking chamber of a circuit breaker in opposite directions, for example by means of a lever.

2. State of the Prior Art

Apparatuses for circuit breaking at medium and high voltages comprise a pair of contacts that are movable relative to each other between a closed position, in which the electric current is able to flow, and an open position in which the electric current is interrupted.

The speed of separation between the contacts is one of the main parameters for guaranteeing the dielectric integrity of the circuit breaker during its opening operation.

In order to reduce the drive energy, while at the same time increasing the speed of separation of the contacts, in particular during the operation of breaking the circuit in a circuit breaker, it has been proposed to design two contacts that are movable relative to each other and that are driven by means of a single drive member.

By convention, an electrical contact (with its anti-corona cap), through which the nominal current passes, is called a "main contact"; and the combination of a main contact and an arcing contact is called a "moving contact".

The other moving contact, opposed to it, also consists of a main contact and an arcing contact.

In particular, document EP 0 822 565 describes a circuit breaker for high and medium voltages in which a lever with two arms, one of which is connected to a nozzle fixed to a first contact, while the other is connected to a second contact, enables the motion of the first contact, which is itself driven by the drive member, to drive the second contact simultaneously in the opposite direction.

In place of a system with a lever having two arms, the return system can be achieved by a belt or a chain, passing around two wheels: see document FR 2 774 503.

However, during the process of breaking high currents, it has been found that hot gases can be projected into the vicinity of the main contacts. The presence of those hot gases can give rise to dielectric ignition. This type of ignition can destroy the circuit breaker.

In general terms, the generation of these hot gases requires the circuit breaker to be over-dimensioned. Yet compactness is always a major factor in the cost of circuit breakers.

SUMMARY OF THE INVENTION

Among other advantages, the invention proposes mitigating the above-described drawbacks, to achieve a system with double-acting movement of the contacts, in which drive energy is further reduced, while having no detrimental effect on the compactness of the circuit breaker.

To this end, the invention provides a circuit breaker for high or medium voltages, comprising at least the following:

a drive bar coupled to a drive member in such a manner as to move in translation along an axis (A-A'); and a circuit-breaking chamber comprising:

a first contact comprising a main contact, an arcing contact, and an electric arc blast nozzle, all secured together, the first contact being movable along the axis in translation;

a second contact disposed facing the first contact and comprising a main contact and an arcing contact that are secured to each other, the second contact being likewise movable in translation along the axis; and transmission means for separating the first contact and second contact from each other during a circuit-breaking operation.

According to the invention, the second contact and the drive bar are coupled together through coupling means such that they move together in translation in the same direction, and in which the transmission means are disposed on the side of the said chamber that is adjacent to the drive bar and are adapted to transmit the motion of the driven second contact to the first contact.

It should be understood that, in the context of this invention, the phrase "disposed on the side of the said chamber that is adjacent to the drive bar" is to be understood to mean the side facing towards the drive bar and therefore facing towards the drive mechanism (which is another designation for the drive member), and facing towards the column insulator.

The drive member connected to the drive bar supplies the energy for driving the drive bar, and it can be of any type, for example hydraulic, pneumatic, mechanical, or electrical.

The drive bar is coupled firstly to the drive member and secondly to the circuit-breaking chamber, via at least one coupling member, for example a pivot pin.

The first contact produces the gas compression that enables circuit-breaking performance to be guaranteed. Thus the stroke, C1, of the said first contact along the main axis A-A' is determined depending on the circuit-breaking performance that is to be attained. The stroke C2 of the second contact is shorter than the stroke C1 of the first contact.

The combination of the drive member and the drive bar constitutes a moving mass M3.

A circuit breaker of this kind enables the drive energy to be reduced as compared with a circuit breaker that has a "non-inverted" circuit breaker chamber in accordance with the current state of the art, that is to say a circuit breaker with a drive bar that is connected to the first contact, of mass M1, and with its transmission means, arranged on the side of the chamber opposite to the drive bar, being adapted to transmit the motion of the driven first contact to the second contact, of mass M2.

In the designs according to the current state of the art, the assembly having a total mass that is equal to the sum M3+M1 performs a stroke C1, while the mass M2 performs a stroke C2. The mass M3+M1 is much larger than the mass M2. In addition, the stroke C1 is greater than the stroke C2.

Given that the kinetic energy consumed is proportional to the product of the moving mass multiplied by the square of the stroke, in order to reduce the drive energy at an identical operating speed, it is proposed, in an inverted architecture of the invention, to arrange for the smallest stroke C2 be performed by the heaviest moving assembly (that containing the mass M3), so as to improve the energy budget. The drive member with the drive bar (i.e. the mass M3) can than be coupled to the second moving contact of the chamber (of mass M2). Thus, the greater moving mass, equal to the mass M3+M2 (much greater than the mass M1), performs the shortest stroke C2.

One example of a possible application of the invention is as follows:

the mass M1 of the first contact is equal to twice the mass M2 of the second contact: M1=2×M2;

the drive member and the drive bar have a mass M3 that is equal to three times the mass of the first contact: M3=3×M1; and the stroke of the first contact C1 is equal to a value of the order of 1.3 times the displacement of the second contact: C1=1.3×C2.

Thus in this example, the ratio between the kinetic energy in the inverted architecture of the invention and the kinetic energy in the standard architecture of the current state of the art is of the order of 0.7.

This means that, because of the arrangement provided by the invention, a saving in kinetic energy consumed is obtained, being 30% in this example.

The invention inverts the structure of a circuit-breaking chamber having two double-acting contacts, by reversing their positions relative to the column insulator, and thus connecting the drive bar to the second contact that has the smaller course of movement.

The fact that the mass of the second contact is also, in general, smaller than that of the first contact improves the energy budget even more.

This makes it possible to employ conventional models of contacts, as hitherto used.

Advantageously, the fact that the drive means are disposed on the side of the chamber adjacent to the drive bar enables a circuit breaker of the invention to be made with compactness that is comparable with the current state of the art.

In one version of the invention, the transmission means of the invention are adapted, during the circuit-breaking operation, to transmit to the first contact a total stroke that is greater than the total stroke of the second contact.

Preferably, the transmission of the motion of the driven second contact to the first contact is effected by means of the blast nozzle.

Advantageously, the transmission means include at least one return lever having two arms, one of which is coupled to a first connecting rod, the other one being coupled to a second connecting rod, the first connecting rod and second connecting rod being also coupled to the first contact and second contact. Preferably, the return lever is pivoted about a pivot axis secured to the chamber, the two said arms having different lengths. In this configuration, the pivot axis of the lever is orthogonal to the axis A-A' of the said chamber, and more preferably, the two axes intersect each other.

In another version, the two said arms of the same lever are aligned with each other.

In order to reduce still further the drive energy of the circuit breaker of the invention, the two arms of the same return lever are preferably obtained by forming a cranked member of the boomerang type, the inner side of which faces towards the drive bar, whereby, during a circuit-breaking operation, the displacement of the first contact is retarded relative to that of the second contact.

In a variant that enables drive energy to be optimized, the point of articulation of the first connecting rod to the corresponding arm, or the point of articulation of the second connecting rod to the corresponding arm, consists of an axial eccentric that serves, during a circuit-breaking operation, to retard the displacement of the first contact relative to that of the second contact, or vice versa.

Where the main contacts are cylindrical in form, it is of advantage to improve their guidance, and in particular to eliminate the radial forces applied on the main contacts while they are being displaced. To this end, the transmission means comprise at least two identical return levers that are disposed symmetrically relative to the axis, each of them having two arms, each said arm being coupled, respectively, to a first connecting rod and to a second connecting rod, with each connecting rod being itself also connected, respectively, to the first contact and to the second contact.

In an advantageous embodiment, the coupling means are adapted to couple the drive bar directly to the second contact. In this version, the coupling means may comprise a coupling pin, for example a cotterpin, transverse to the said axis, the said coupling pin being inserted through the arcing contact rod and the drive bar.

Alternatively, in another embodiment, the coupling means are adapted in such a way as to couple the drive bar indirectly to the second contact. In this alternative version, the coupling means include two links, one said link consisting of the second connecting rod, and the other said link being coupled directly, firstly to the drive bar and secondly, directly to the second connecting rod. Advantageously, the transmission means comprise a return lever, having an arm configured to offset towards the contacts the point of articulation of the second connecting rod on the arm, by an angle A relative to the point of articulation of the other connecting rod, serving, during a circuit-breaking operation, to retard the displacement of the second contact relative to that of the first contact.

Advantageously, the second main contact comprises a hollow metal tube, the inner diameter of which is substantially equal to the outer diameter of a metal member that is fixed to the blast nozzle, the strokes C1 and C2 being so determined that the metal member projects out from the hollow metal tube at the end of the opening operation, and thereby constitutes a field electrode for reducing the field on the second arcing contact.

The invention also provides a circuit breaker for high or medium voltage, comprising at least the following:

a first insulating envelope in which there is mounted a drive bar adapted to move in translation along an axis (A-A'); and a second insulating envelope that is attached to the first insulating envelope, and in which there is mounted a circuit-breaking chamber comprising at least one main contact, an arcing contact, and a blast nozzle for extinguishing an arc, all fixed together, wherein, in the circuit breaker, the circuit-breaking chamber is in communication with the interior of the first insulating envelope, and wherein the arc blast nozzle includes a divergent portion that is oriented towards the first insulating envelope, in such a way that at least some of the hot gases resulting from extinguishing the arc penetrate into the interior of the first insulating envelope.

An arrangement of this kind enables the amount of hot gas that is redirected towards the contacts to be considerably reduced, thereby avoiding the risk of electrical arcing.

BRIEF DESCRIPTION OF THE DRAWINGS

The features and advantages of the invention can be understood more clearly on a reading of the following description and with reference to the accompanying drawings, which are given for the purposes of illustration and are in no way limiting.

DETAILED DESCRIPTION OF PARTICULAR EMBODIMENTS

Figures 1A, 1B:
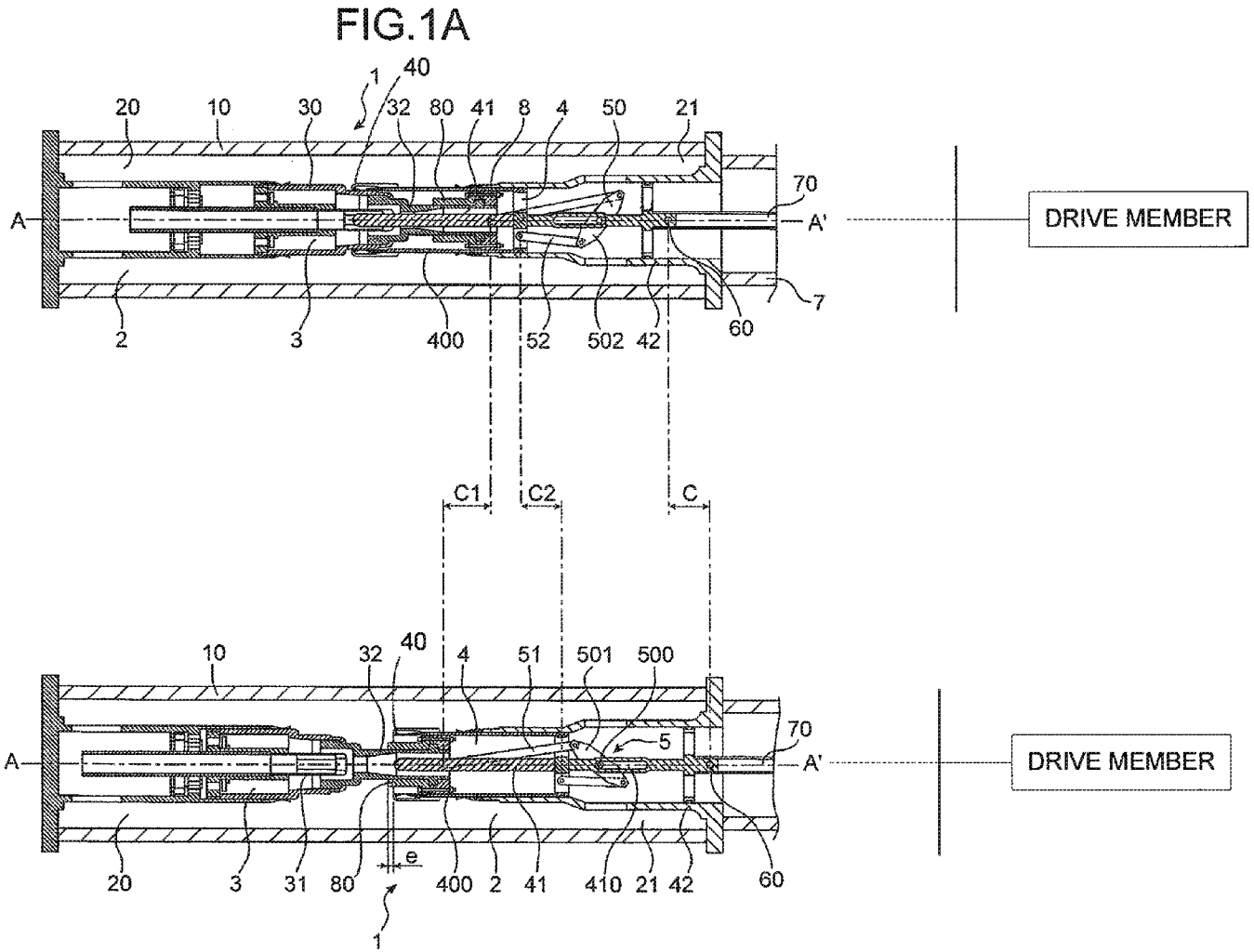
FIGS. 1A and 1B show diagrammatically a double-acting circuit breaker chamber having direct coupling means and transmission means in a first embodiment of the invention, and in which the contacts are in their fully closed and fully open positions respectively.

A circuit breaker 1 for high or medium voltages is shown in the drawings in a "live tank" application. This type of design of a chamber with an inverted structure is of value whatever type of circuit breaker is concerned. The circuit breaker 1, as shown in FIGS. 1A and 1B, first of all comprises a circuit-breaking chamber 2 that can be filled with a dielectric gas of the $SF_6$ type.

The circuit breaker chamber 2 has two ends 20 and 21, and includes a first moving contact 3 that consists of a main contact 30 and an arcing contact 31, which is in the form of a tulip for example, together with a second moving contact 4 that consists of a main contact 40 that, in the present example, is in the form of a hollow tube 400, and an arcing contact 41 which in this example is in the form of a rod. These two contacts 3 and 4 co-operate with each other between an open end-position (FIG. 1B, FIG. 2C and FIG. 4C), in which the two moving contacts 3 and 4 are separated from each other, and a closed end-position (see FIG. 1A, FIG. 2A and FIG. 4A), in which electric current can pass between them.

During the circuit-breaking process, the main contacts 30 and 40 are separated from each other, and the arcing contacts 31 and 41 then also separate from each other after a delay period, to form an electric arc that is extinguished by blasting the arc through the nozzle 32.

The first contact 3 is conventionally fixed relative to a nozzle 32 that is itself an extension of a gas compression space. This dielectric nozzle serves as a blowhole for blasting the gas passing towards the electrical arc from the compression space.

The two contacts 3 and 4 and the nozzle 32 are displaced along the main axis A-A' of the circuit-breaking chamber 2 of the circuit breaker 1. The breaking chamber 2, nozzle 32, and first and second contacts 3 and 4 are preferably symmetrical about the axis A-A'.

The mass M1 of the main contact 3 (including that of the blast nozzle 32) is in general greater than the mass M2 of the second contact 4.

Each of the contacts 3 and 4 is actuated, for moving apart or coming together, by means of a single transmission mechanism 5.

The transmission mechanism 5 preferably comprises a lever 50 with two arms 501 and 502, pivoting about an axis 500 fixed to the chamber 2, one of these arms, 501, being connected to a first connecting rod 51 while the other arm 502 is connected to a second connecting rod 52, the first connecting rod 51 and the second connecting rod 52 being also coupled to the first contact 3 and the second contact 4 respectively.

Preferably also, the pivot axis 500 for the lever 50 is orthogonal to the displacement axis A-A', in such a manner that the ends of the arms 501 and 502, and therefore the connecting rods 51 and 52, are displaced in a planar movement that imposes reduced stress on their anchor points. For reasons of symmetry and ease of assembly, the pivot axis 500 for the lever 50 preferably intersects the displacement axis A-A'.

In the embodiment shown in FIGS. 1A and 1B, the two arms 501 and 502 of the same lever 50 are in alignment with each other.

The circuit breaker 1 of the invention further includes a column insulator 7 on the front of, and attached to, the circuit-breaking chamber 2. A drive bar 70 is coupled to a drive mechanism, which transmits to it movement in translation along the axis A-A'. The drive bar 70 extends through the interior of the column insulator 7, which in the present example is cylindrical.

In accordance with the invention, the second contact 4 and the drive rod 70 are coupled together through coupling means 6, in such a manner that they move together in translation in the same direction. The transmission mechanism 5 is disposed on the side 21 of the chamber 2 adjacent to the drive bar 70, and is adapted to transmit motion from the driven second contact 4 to the first contact 3. The energy thus necessary for separating the two contacts 3 and 4 is reduced as compared with a circuit-breaking chamber in accordance with the current state of the art, which makes use of the same means but in which the drive bar and the first contact are coupled together.

As is shown in FIGS. 1A and 1B, FIGS. 2A to 2C and FIGS. 4A to 4C, the transmission mechanism 5, that is to say the form and dimensions of the lever 50 and connecting rods 51, 52, together with their arrangement in the circuit-breaking chamber 2, make it possible, during the circuit-breaking process, to transmit a total stroke, C1 of the first contact 3 that is greater than the total stroke, C2 of the second contact 4.

Figure 2A:
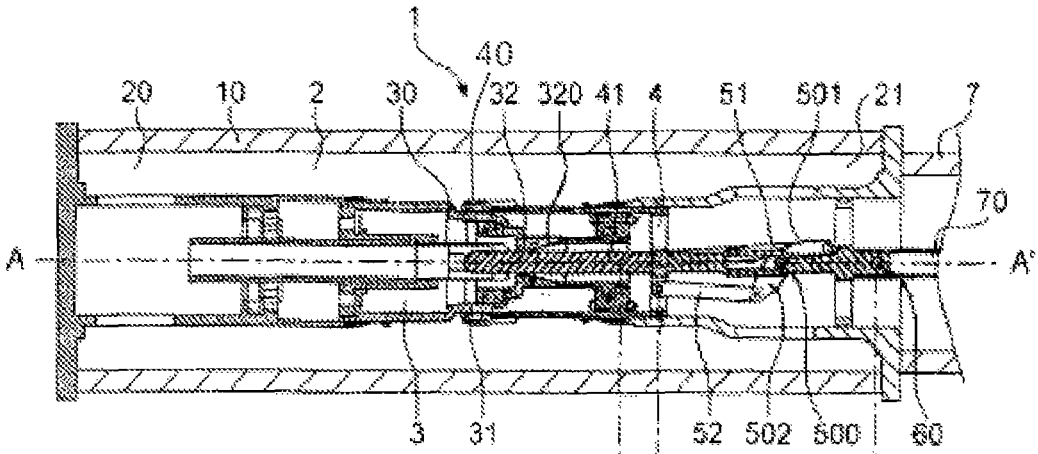
FIGS. 2A, 2B, and 2C show diagrammatically an advantageous modified version of the transmission means of the embodiment shown in FIGS. 1A and 1B, the contacts here being shown in their closed, intermediate and open positions respectively.
Figure 2B:
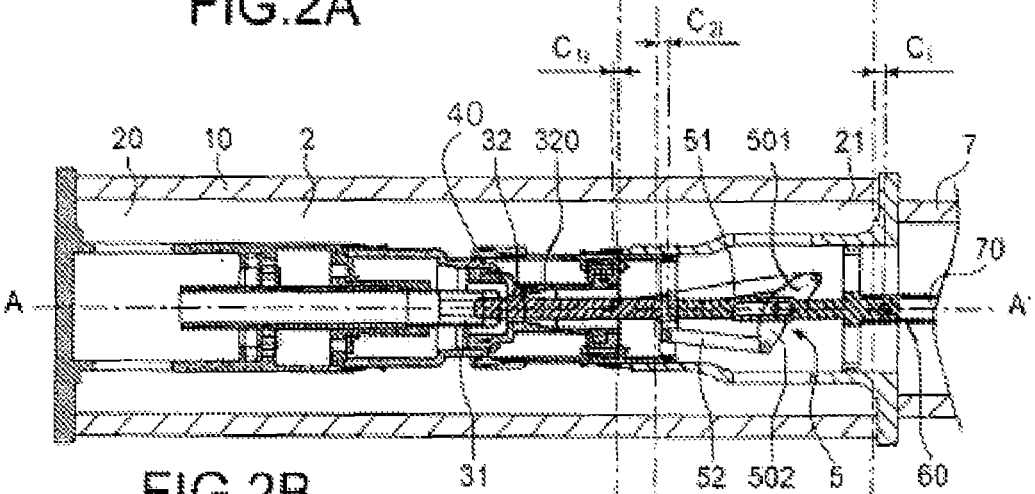
Figure 2C:
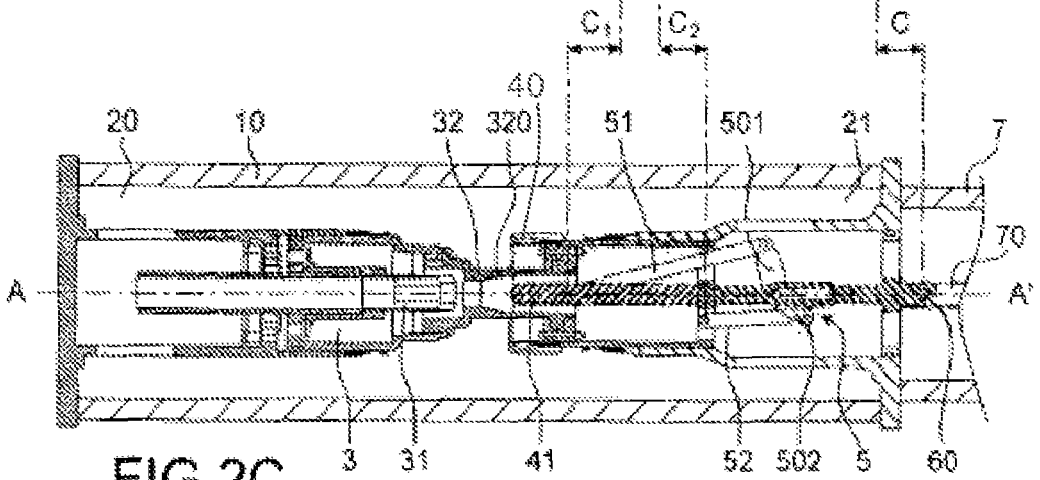

In the embodiments shown in FIGS. 1A and 1B and in FIGS. 2A to 2C in a first modified version, the coupling means between the drive bar 70 and the second contact 4 are arranged to be coupled directly in order thereby to make it unnecessary to provide any additional components. As shown, these coupling means 6 consist of a coupling pin 60 transverse to the axis A-A' and inserted through the arcing contact rod 41 and the bar 70. In an alternative second modified version, the coupling means 6 are arranged for indirect coupling. One version of such an indirect coupling arrangement is described below with reference to FIGS. 4A to 4C.

In order to reduce still further the drive energy necessary to separate the two contacts 3 and 4 from each other during a circuit-breaking operation, it is of advantage to provide a delay in the displacement of the first contact 3 relative to that of the second contact 4.

The embodiment shown in FIGS. 2A to 2C is a first modified version for obtaining this delay in displacement. In these figures, the two identical arms 501 and 502 are embodied by making a cranked member of a boomerang type, the inner side of which is in facing relationship with the drive bar 70.

FIG. 2B shows an intermediate position in the opening operation starting in the closed position (FIG. 2A), in which intermediate position the stroke Ci of the drive bar 70 is the same as the stroke C2*i* of the second contact 4, while the stroke C1*i* of the first contact 3 is shorter. By retarding the displacement of the first contact 3, the geometry of the boomerang thus enables the drive force to be distributed along the length of the stroke performed during opening. The fact that the departure of one of the contacts 3 or 4 is retarded thus enables the drive energy to be concentrated on the other contact. The apparent mass, in motion, of the moving parts of the chamber 2 is therefore smaller than the total mass of the moving parts of the chamber when in motion, which helps in making separation of the contacts 3 and 4 faster.

FIG. 2C shows the position at the end of the opening movement, at which the drive bar 70 has performed a total stroke C, which is equal to the stroke C2 of the second contact 4 and smaller than the stroke C1 of the first contact 3.

Figure 2D:
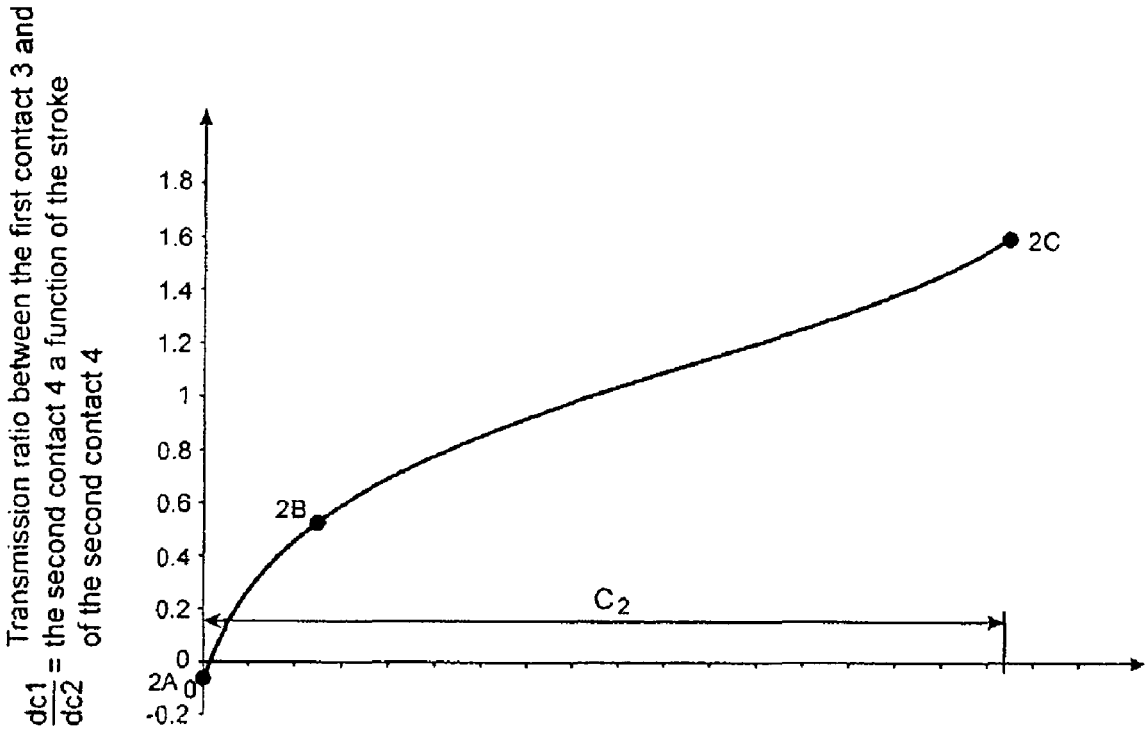
FIG. 2D shows the curve that, over the entire stroke of the opening process, represents the relative displacement ratio between the first contact and the second contact that is obtained by virtue of the transmission means shown in FIGS. 2A to 2C.

FIG. 2D shows the curve that represents the transmission ratio between the first contact 3 and second contact 4 shown in FIGS. 2A to 2C, over the total opening travel C=C2. The points 2A, 2B, and 2C represent the values of the transmission ratio in FIGS. 2A, 2B, and 2C respectively.

It can be seen that, by means of the specific shape of the boomerang lever 50, the transmission ratio is very low at the start of the opening operation, which signifies that displacement of the contact 3 is retarded.

It can also be seen that, between the intermediate position (point 2B) and the final open position (point 2C), by means of the specific shape of the boomerang there is a high acceleration of the first contact 3. Since the first contact 3 also compresses the gas so that the current is cut off, this compression is then achieved rapidly. This improves overpressure when empty, and accordingly reduces dependence on loss of gas through points of leakage (leakage cross-sections). In this regard, the rise in total pressure consists of a reduction in volume followed by an expansion through the leakage points. In addition, the faster the reduction in volume, that is to say the more the relative displacement between the contacts 3 and 4 is rapid (transmission ratio greater than 1), the smaller will be the relative loss of pressure through the leakage points. Finally, by maintaining a high displacement ratio at the end of the movement, at the instant at which the leakage cross-sections are at their largest, the impact of these leakage cross-sections or leakage points is limited, and this therefore results in a gain in pressure.

Figure 3A:
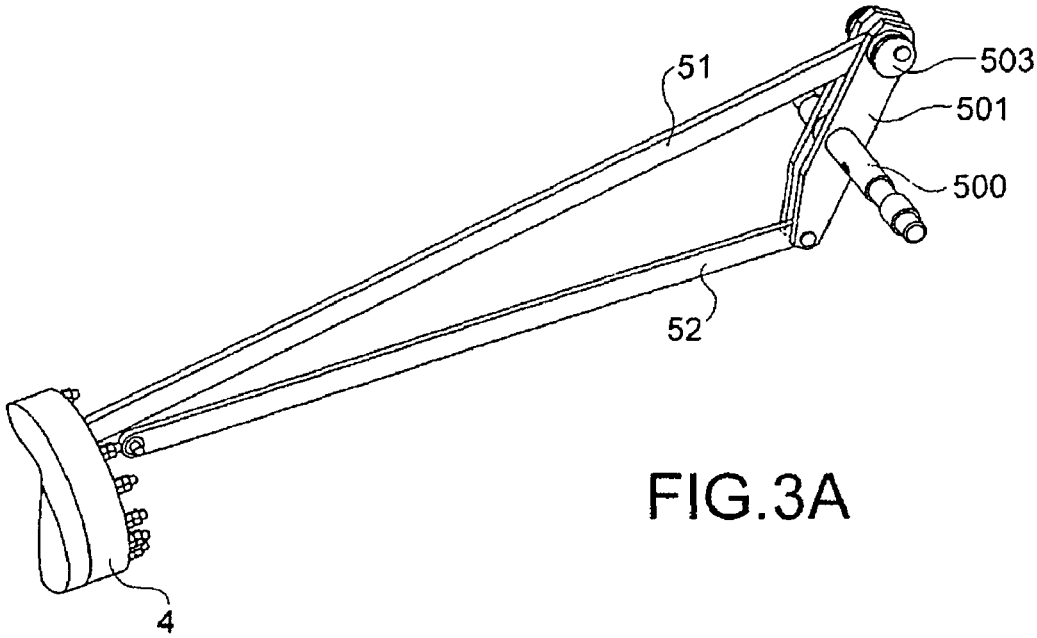
FIG. 3A shows diagrammatically a further advantageous modified version of the transmission means for the embodiment shown in FIGS. 1A and 1B.

The embodiment shown in FIG. 3A is a second modified version for achieving the delay in displacement. In this figure, the articulation point of the first connecting rod 51 to the arm 501 consists of an axial eccentric 503. This eccentric 503 lowers the peak value of the force at the start of the manoeuvre, and, just as with a lever 50 of the boomerang type, the drive energy is concentrated on the other contact 4.

Figure 3B:
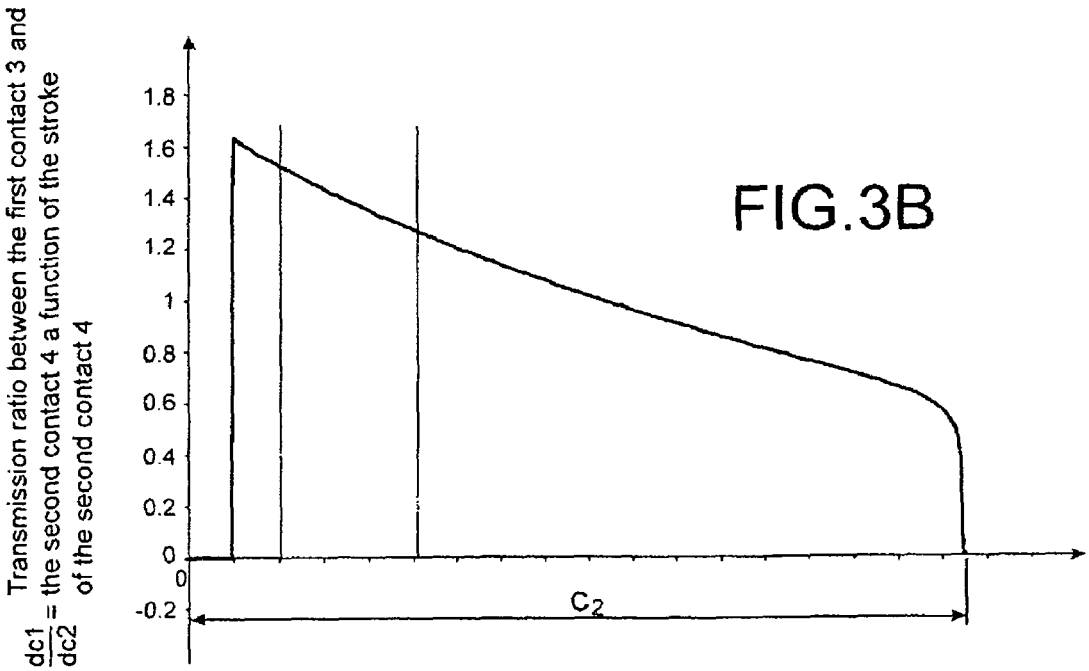
FIG. 3B shows the curve that, over the entire stroke of the opening process, represents the relative displacement ratio between the first contact and the second contact that is obtained with the transmission means shown in FIG. 3A.

FIG. 3B shows the curve of the value of transmission ratio between the first contact 3 and second contact 4 shown in FIG. 3A, over the total stroke during opening, C=C2.

It can be seen that, by means of the eccentric 503, the displacement of the first contact is zero over a certain amount of the movement (C1*i*/C2*i*=0). The peak value of drive force at the start of the opening operation is proportional to the total mass of the components that are put in motion. By thus delaying the beginning of the movement of the first contact 3, the peak value of force to set the second contact 4 in motion is delayed, and the forces in the components, for example in the drive bar 70, are therefore greatly reduced. The speed with which the contacts are separated with a given value of opening energy, here of the order of 15%, is also substantially increased.

Figure 4A:
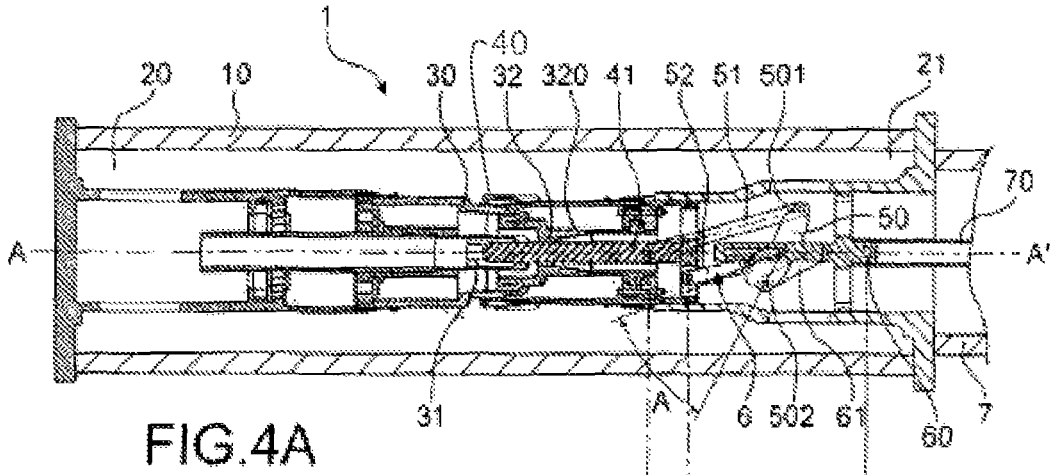
FIGS. 4A, 4B, and 4C show diagrammatically a double-acting circuit-breaking chamber having indirect coupling means and transmission means in a second embodiment of the invention, the contacts being shown in their closed, intermediate, and open positions respectively.
Figure 4B:
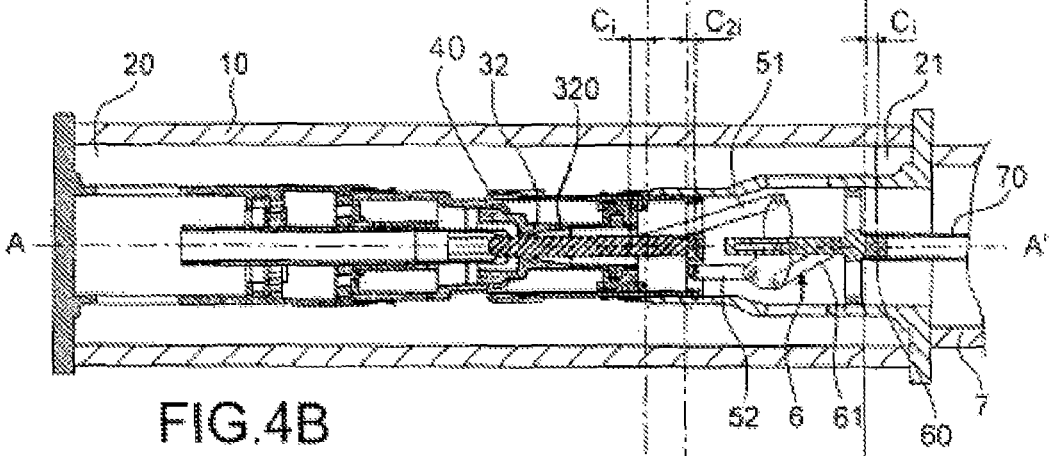
Figure 4C:
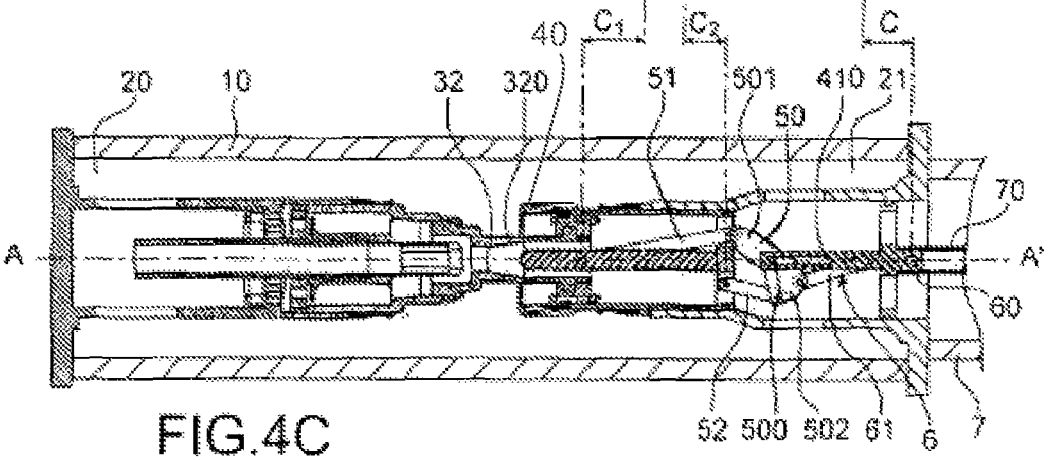

The embodiment shown in FIGS. 4A to 4C is an advantageous version in accordance with which the coupling between the drive bar 70 and the second contact 4 is obtained indirectly, and the indirect coupling means 6 enable the displacement of the second contact 4 relative to that of the first contact 3 to be retarded during a circuit-breaking operation.

As shown in FIGS. 4A to 4C, the coupling means 6 comprise two links 52 and 61, one of which, the link 52, consists of the second connecting rod while the other one, the link 61, is coupled directly, firstly to the drive bar 70 and secondly to the second connecting rod 52 directly. The transmission means 5 comprise a return lever 50, one of the arms of which, the arm 502, is so configured that the point in which the second connecting rod 52 is articulated to the arm 502 is offset, through an angle A, relative to the point of articulation of the second transmission link 61, the said angle A enabling the delay in displacement of the second contact 4 to be obtained.

The link 61 transmits the displacement of the drive bar 70 to the return lever 50. Accordingly the arm 502 has two pivot axes, and the arm 501 is aligned with the one connected to the link 61. The displacement of the first contact 3 is therefore not delayed relative to the displacement of the drive bar 70.

In FIG. 4B, showing an intermediate position in the displacement, it can be seen that for an amount of displacement Ci of the drive bar 70, the displacement of the first contact 3, C1*i* is greater. This is due to the ratio of the arms 501 and 502 of the lever 50.

It can also be seen that the distance C2*i* traveled by the second contact 4 is less than the distance Ci traveled by the bar 70. This is due to the boomerang shape of the lever 50, the inner side of which is in facing relationship to the opposed side 21 of the chamber 2.

In accordance with the invention, the delay in displacement can be reversed, that is to say the second contact 4 undergoes a delay in displacement relative to the first contact 3 during the opening operation. For example, the articulation of the second connecting rod 52 to the arm 502 may consist of an eccentric 503 similar to that in FIG. 3A, and will therefore retard the second contact 4.

Figure 5:
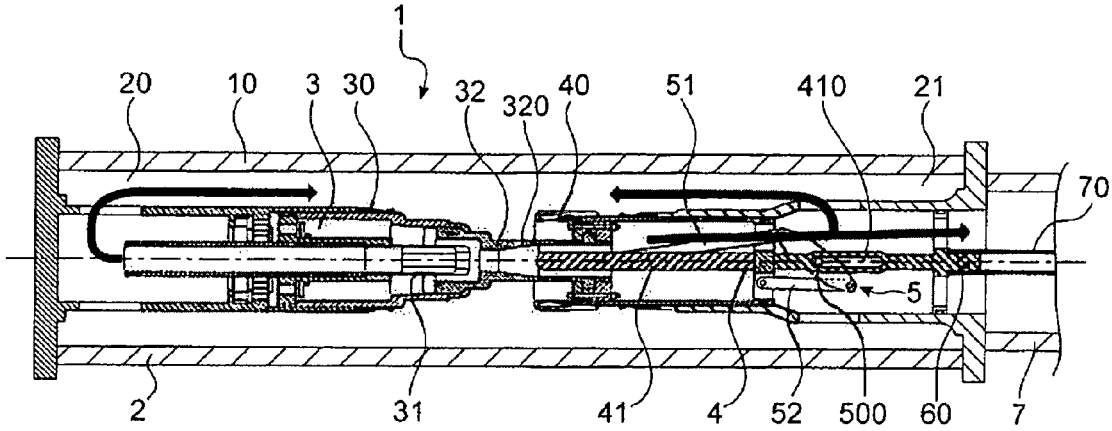
FIG. 5 is structurally identical with FIG. 1B, but it illustrates diagrammatically the path followed by the hot gases during the process of breaking high currents.

In FIG. 5, which is structurally identical to FIG. 1B, arrows indicate the path followed by the hot gases at the end of an operation of breaking high currents, as provided by the invention, these currents being typically of the order of 50 kiloamps (kA).

In this regard, when such high currents are being broken, there may very well occur blowbacks of hot gas in the region of the main or permanent contacts 30 and 40. Such blowbacks can lead to the dielectric ignition of the circuit-breaking chamber 2, on the parallel contacts, and may then cause the circuit breaker 1 to explode. The danger of this happening is increased as the volume of $SF_6$ gas contained in the chamber insulator 10 is progressively reduced. Now during an operation of breaking a high current, a quantity of hot gas that is expelled through the divergent portion 320 of the nozzle 32 is much higher than the quantity of gas that is expelled through the current-carrying tube on the side of the first contact 3 (which is indicated by the black arrow situated on the left hand side of FIG. 5). In addition, the volume of $SF_6$ gas that is present in the column insulator 7 is in communication with the internal space of the circuit-breaking chamber; therefore, some of the volume of gas in the column 7 may assist in breaking high currents. In the form of construction shown for a circuit-breaking chamber 2 of the invention, the divergent side 320 of the blast nozzle 32 is oriented towards the column insulator 7, and therefore the volume of the $SF_6$ gas in the column 7 is on the side in which the wave of hot gas is greatest. In consequence, the quantity of hot gas coming from the divergent portion of the nozzle 32, and directed towards the parallel contacts 30 and 40, is smaller than in a design of circuit breaker according to the current state of the art. This division of the quantity of hot gas blown back is illustrated by the separation of the gas flow arrows on the right hand side of FIG. 5, the extreme right hand arrow showing the passage of some of the hot gas towards the interior of the column insulator 7, with the arrow showing blow back towards the contact 30 illustrating the return of a much smaller quantity of gas towards the said contact 40. With careful choice of the dimensions for the leakage points or leakage cross sections for gas between the column insulator 7 and the chamber 2, the quantity of gas blown back can be reduced in such a way as to avoid any risk of electrical arcing.

As is shown in FIG. 1B, the second main contact 40 comprises a hollow metal tube 400, the inner diameter of which is substantially equal to the outer diameter of a metal member 8 that is fixed to the blast nozzle, the strokes (C1) and (C2) being set to be such that the metal member 8 projects out of the hollow metal tube 400 by a distance e at the end of the opening operation, and therefore constitutes a field electrode 80 that reduces the electric field over the second arcing contact 41.

Figure 6:
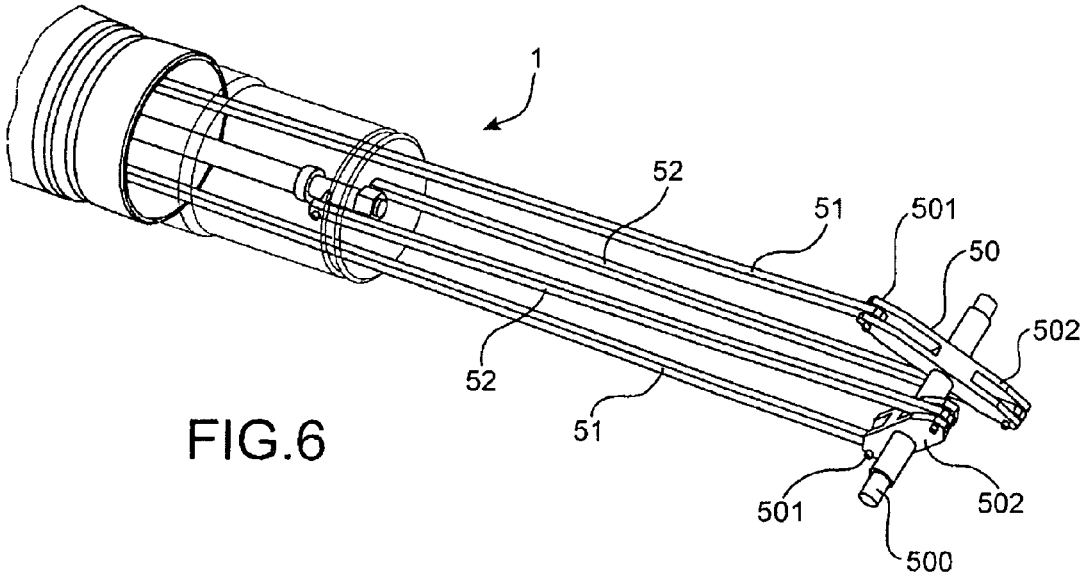
FIG. 6 shows diagrammatically an advantageous modified version of the transmission means according to the invention.

FIG. 6 illustrates a modified embodiment within the scope of the invention, which enables guidance of the cylinders 30 and 40 to be improved, and the radial forces applied to them to be reduced. In this version, the transmission means 5 comprise at least two identical return levers 50 that are disposed symmetrically relative to the axis A-A', each of them having a pair of arms 501 and 502, with each of the arms 501 and the arms 502 being connected to a first connecting rod 51 and a second connecting rod 52 respectively, these connecting rods being themselves each also connected to the first contact 3 and second contact 4 respectively.

In all of the embodiments shown in the drawings, the arcing contact rod 41 has an oblong aperture 410, through which the pivot pin 500 of the return lever 5 passes. Thus, the dimensions of the oblong aperture 410 enable the rod to slide about the pivot pin 500 throughout the opening movement C2. The advantage of this construction is its practical simplicity.

The invention claimed is:

1. A circuit breaker for high or medium voltages, comprising at least the following:

a drive bar movable in translation along an axis (A-A');

a drive member coupled to the drive bar to move the drive bar in translation along the axis (A-A');

a circuit-breaking chamber comprising:

a first contact comprising a main contact, an arcing contact, and a blast nozzle for extinguishing an electric arc, all fixed together, the first contact movable in translation along the axis (A-A');

a second contact disposed facing the first contact and comprising a main contact and an arcing contact that are fixed to each other, the second contact movable in translation along the axis (A-A'); and transmission means for separating the first contact and second contact from each other during a circuit-breaking operation, and a column insulator in communication with the circuit breaking chamber, the drive bar extending through the interior of the column insulator;

wherein the drive bar is coupled to the second contact by coupling means to move the second contact in translation along the axis (A-A') in the same direction as the drive bar, and wherein the transmission means are disposed on the side of the said chamber that is adjacent to the drive bar and are adapted to transmit the motion of the driven second contact to the first contact.

2. A circuit breaker according to claim 1, wherein the transmission means are adapted to transmit to the first contact a total stroke (C1) of the first contact that is greater than a total stroke (C2) of the second contact during the circuit-breaking operation.

3. A circuit breaker according to claim 1, wherein the transmission of the motion of the driven second contact to the first contact is effected by the blast nozzle.

4. A circuit breaker according to claim 1, wherein the transmission means include at least one return lever having two arms, one of which is coupled to a first connecting rod, the other one being coupled to a second connecting rod, the first connecting rod and second connecting rod being also coupled to the first contact and second contact.

5. A circuit breaker according to claim 4, wherein the return lever is pivoted about a pivot axis fixed to the chamber, the two said arms having different lengths.

6. A circuit breaker according to claim 5, wherein the pivot axis of the lever is orthogonal to the axis (A-A') of the said chamber.

7. A circuit breaker according to claim 5, wherein the pivot axis of the lever intersects the said axis (A-A').

8. A circuit breaker according to claim 4, wherein the two said arms of the same return lever are aligned with each other.

9. A circuit breaker according to claim 4, wherein the two arms of the same return lever are obtained by forming a cranked member of the boomerang type facing the drive bar in order to retard, during a circuit-breaking operation, the displacement of the first contact relative to that of the second contact.

10. A circuit breaker according to claim 4, wherein the point of articulation of the first connecting rod to the corresponding arm, or the point of articulation of the second connecting rod to the corresponding arm, comprises an axial eccentric that serves to retard, during a circuit-breaking operation, the displacement of the first contact relative to that of the second contact.

11. A circuit breaker according to claim 4, wherein the transmission means comprise at least two identical return levers that are disposed symmetrically relative to the axis (A-A'), each of them having two arms, each said arm being coupled, respectively, to a first connecting rod and to a second connecting rod, with each connecting rod being itself also connected, respectively, to the first contact and to the second contact.

12. A circuit breaker according to claim 11, wherein the coupling means are adapted to couple the drive bar directly to the second contact.

13. A circuit breaker according to claim 12, wherein the coupling means comprise a coupling pin transverse to the said axis (A-A'), the said coupling pin being inserted through the arcing contact rod and the drive bar.

14. A circuit breaker according to claim 1, wherein the coupling means are adapted to couple the drive bar indirectly to the second contact.

15. A circuit breaker according to claim 14, wherein the coupling means include two links, one said link consisting of the second connecting rod, and the other said link being coupled directly, firstly to the drive bar and secondly, directly to the second connecting rod.

16. A circuit breaker according to claim 15, wherein the transmission means comprise a return lever, having an arm configured to offset towards the contacts the point of articulation of the second connecting rod on the arm, by an angle relative to the point of articulation of the other connecting rod, serving to retard, during the operation of separating the contacts, the displacement of the second contact relative to that of the first contact.

17. A circuit breaker according to claim 1, wherein the second main contact comprises a hollow metal tube, the inner diameter of which is substantially equal to the outer diameter of a metal member that is fixed to the blast nozzle, a total stroke (C1) of the first contact and a total stroke (C2) of the second contact being so determined that the metal member projects out from the hollow metal tube at the end of the opening operation, and thereby constitutes a field electrode for reducing the field on the second arcing contact.

18. A circuit breaker for high or medium voltage, comprising at least the following:

a first insulating envelope in which there is mounted a drive bar adapted to move in translation along an axis (A-A'); and a second insulating envelope that is attached to the first insulating envelope, and in which there is mounted a circuit-breaking chamber comprising a first contact comprising a main contact, an arcing contact, and a blast nozzle for extinguishing an arc, all fixed together, and a second contact comprising a main contact and an arcing contact fixed together;

wherein the circuit-breaking chamber is in communication with the interior of the first insulating envelope, and wherein the arc blast nozzle in the circuit-breaking chamber includes a divergent portion that is oriented towards the first insulating envelope, wherein extinguishing the arc results in hot gases that penetrate into the interior of the first insulating envelope and the interior of the second insulating envelope.

19. A circuit breaker for high or medium voltages, comprising at least the following:

a drive bar movable in translation along an axis (A-A'); and a circuit-breaking chamber comprising:

a first contact comprising a main contact, an arcing contact, and a blast nozzle for extinguishing an electric arc, all fixed together, the first contact movable in translation along the axis (A-A');

a second contact disposed facing the first contact and comprising a main contact and an arcing contact that are fixed to each other, the second contact movable in translation along the axis (A-A'); and transmission means for separating the first contact and second contact from each other during a circuit-breaking operation, wherein the second contact and the drive bar are coupled together such that they move together in translation in the same direction, and wherein the transmission means are disposed on the side of the said chamber that is adjacent to the drive bar and are adapted to transmit the motion of the driven second contact to the first contact, and wherein the second main contact comprises a hollow metal tube, the inner diameter of which is substantially equal to the outer diameter of a metal member that is fixed to the blast nozzle, a total stroke (C1) of the first contact and a total stroke (C2) of the second contact being so determined that the metal member projects out from the hollow metal tube at the end of the opening operation, and thereby constitutes a field electrode for reducing the field on the second arcing contact.

* * * * *